US010573137B2

(12) United States Patent
Jiang et al.

(10) Patent No.: US 10,573,137 B2
(45) Date of Patent: Feb. 25, 2020

(54) METHOD AND DEVICE FOR GENERATING VIBRATING SIGNAL

(71) Applicant: AAC Technologies Pte. Ltd., Singapore (SG)

(72) Inventors: Liang Jiang, Shenzhen (CN); Xiang Lu, Shenzhen (CN); Yulei Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/057,940

(22) Filed: Aug. 8, 2018

(65) Prior Publication Data

US 2019/0206201 A1 Jul. 4, 2019

(30) Foreign Application Priority Data

Dec. 29, 2017 (CN) ..... 2017 1 1482888

(51) Int. Cl.
*G08B 6/00* (2006.01)
*B06B 1/02* (2006.01)

(52) U.S. Cl.
CPC . *G08B 6/00* (2013.01); *B06B 1/02* (2013.01)

(58) Field of Classification Search
CPC ..... G05D 19/02; G08B 6/00; H02P 29/50; H02P 25/032; H02P 23/0077
See application file for complete search history.

(56) References Cited

U.S. PATENT DOCUMENTS 5,857,986 A * 1/1999 Moriyasu ..... A61H 23/02 273/148 B
9,806,655 B1 * 10/2017 Hu ..... H02P 25/032
10,122,310 B2 * 11/2018 Li ..... H02P 25/032
10,354,499 B2 * 7/2019 Roh ..... H04M 19/047
2009/0073807 A1 * 3/2009 Sitton ..... G01V 1/005 367/38
2011/0026365 A1 * 2/2011 Beckhoven ..... G01S 7/524 367/137
2011/0115709 A1 * 5/2011 Cruz-Hernandez ..... G06F 3/016 345/168
2016/0012687 A1 * 1/2016 Obana ..... G08B 6/00 340/407.1
2017/0188198 A1 * 6/2017 Matsubara ..... H04B 11/00
2017/0228022 A1 * 8/2017 Shimanouchi ..... G06F 3/041
2017/0245070 A1 * 8/2017 Inagaki ..... G10G 1/00
2017/0338762 A1 * 11/2017 Hu ..... H02P 25/032
2018/0120128 A1 * 5/2018 Neuman ..... G01D 5/04
(Continued)

*Primary Examiner* — An T Nguyen
(74) *Attorney, Agent, or Firm* — IPro, PLLC; Na Xu

(57) ABSTRACT

A method and device for generating vibrating signal is provided in the present disclosure. The method of generating a vibrating signal includes the following steps: S10 , generating one unit cycle of basic vibrating signals, wherein the unit cycle is less than a preset threshold; S20 , obtaining N unit cycles of vibrating sub-signals by using the basic vibrating signal as a parent and changing a signal parameter of the basic vibrating signal, wherein the N is a positive integer; and S30 , generating a vibrating signal according to the N unit cycles of vibrating sub-signals. The present invention can generate a vibrating signal that can start to stop immediately, and the vibrating signal can be more rich in constructing the vibration mode, more realistic to simulate the actual vibration, and can be used in a larger range.

5 Claims, 6 Drawing Sheets

(56) References Cited

U.S. PATENT DOCUMENTS

| | | | | |
|---|---|---|---|---|
| 2018/0170229 | A1* | 6/2018 | Hashimoto | B60N 2/90 |
| 2018/0182212 | A1* | 6/2018 | Li | G05D 19/02 |
| 2018/0183372 | A1* | 6/2018 | Li | H02P 25/032 |
| 2018/0316282 | A1* | 11/2018 | Arakawa | H02N 2/008 |
| 2018/0350339 | A1* | 12/2018 | Macours | B06B 1/0253 |
| 2019/0122507 | A1* | 4/2019 | Roh | H04M 19/047 |
| 2019/0206201 | A1* | 7/2019 | Jiang | G08B 6/00 |

* cited by examiner

METHOD AND DEVICE FOR GENERATING VIBRATING SIGNAL

FIELD OF THE DISCLOSURE

The present disclosure relates to the technical field of vibrating signals, and in particular relates to a method and a device for generating a vibrating signal.

BACKGROUND

It is well known that physical characteristics of an object that is vibrating are essentially a reciprocating motion, in which energy is involved in a form of a sinusoidal wave, that is, when driving the object to vibrate, a driving signal should also be in the form of a sinusoidal wave. However, a traditional driving manner is exactly in the form of a cyclic signal.

An inventor finds that at least the following problems exist in the prior art: a traditional cyclic signal generated in the prior art has very high requirements for precision of a signal resonant frequency when performing driving control on a target, and accumulated resonant frequency error generated by a long-term vibration is extremely large; further, a traditional sinusoidal wave form may only gradually strengthen or weaken vibration, therefore, start and stop cannot be controlled well in a practical application. In some special vibrations, for example, a vibration form during actual vibration tactile sensation in a game or a simulated life has very high control requirements for an excitation signal, and a traditional cyclic signal cannot quickly and timely simulate these effects.

Therefore, it is desired to provide a method and a device for generating a vibrating signal to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

A first example of the present disclosure relates to a method of generating a vibrating signal. A core of this example is that one unit cycle of basic vibrating signals is generated, where the unit cycle is less than a preset threshold; N unit cycles of vibrating sub-signals are obtained by using the basic vibrating signal as a parent and changing a signal parameter of the basic vibrating signal, where the N is a positive integer; and a vibrating signal is generated according to the N unit cycles of vibrating sub-signals. Since the unit cycle is very small, the generated basic vibrating signal may be started or stopped immediately, and the vibrating sub-signals obtained by changing the signal parameter of the basic vibrating signal are different in form and also have characteristics of timely stop; therefore, the vibrating signal generated according to the vibrating sub-signals is easily controlled for start and stop, and more abundant vibrating modes may be constructed to more vividly simulate a more complicated actual vibration, and achieve diversified vibration effects. Thus, flexible application may be implemented in a wider range by replacing the traditional sinusoidal vibrating signal. Implementation details of the method of generating a vibrating signal according to an example of the present disclosure will be described below. The following contents are merely the implementation details provided for convenience of understanding and are not necessary to implement a solution of the present disclosure.

Figure 1:
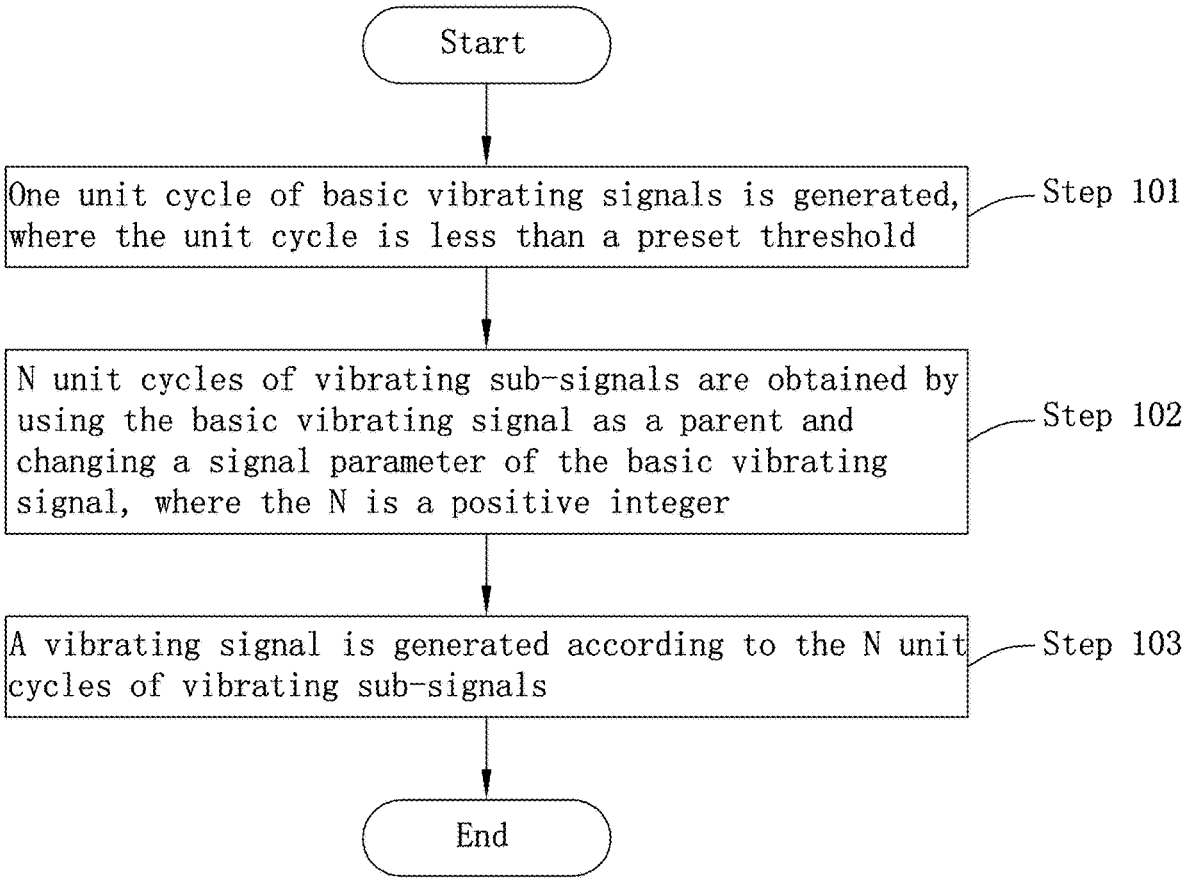
FIG. 1 is a flowchart illustrating a method of generating a vibrating signal according to a first example of the present disclosure.

As shown in FIG. 1, a method of generating a vibrating signal in an example may specifically include the following steps.

Step 101: one unit cycle of basic vibrating signals is generated, where the unit cycle is less than a preset threshold.

Specifically, the unit cycle is a minimum time length for completing start and stop control for a vibrating signal within a tactile frequency range of a human body. Constructing a signal within the tactile frequency range (generally perception of 5 ms and below 300 Hz) of human body may allow the basic vibrating signal to complete and stop a motor vibration within a minimum cycle, with a starting vibration amplitude of BeginGpp=0 and a stopping vibration amplitude of EndGpp<=ε (ε is an extremely small vibration amplitude), and thus the signal can be started or stopped immediately. It may be understood that, in this example, one unit cycle of basic vibrating signals may be generated by a drive of an overload voltage, a voltage range is obviously extended, and a vibration intensity range is also extended, thereby improving the tactile sensation.

Step 102: N unit cycles of vibrating sub-signals are obtained by using the basic vibrating signal as a parent and changing a signal parameter of the basic vibrating signal, where the N is a positive integer.

Specifically, the signal parameter may include one or any combination of the following: a vibrating amplitude, a frequency and a phase parameter. By non-linearly changing the basic vibrating signal, different unit cycles of vibrating sub-signals may be obtained and also may have characteristics of timely stop.

Step 103: a vibrating signal is generated according to the N unit cycles of vibrating sub-signals.

It may be understood that different vibrating signals may be generated according to any combination of the unit cycles of vibrating sub-signals. For example, a particular excitation signal may generate a positive acceleration peak with energy relatively concentrated in a particular cycle, and may also naturally obtain a negative acceleration valley with energy relatively concentrated based on symmetry. By a combination of the both above, a particular cycle of sinusoidal substitute signals with a particular frequency may be implemented. Further, the sinusoidal substitute signals with different frequencies may also be realized by adjusting an excitation signal and a splicing compactness according to a distribution of acceleration amplitudes in a time domain. Due to the characteristics of timely stop of the signal, a good braking effect can also be obtained finally after a plurality of cycles is superimposed.

Figure 2:
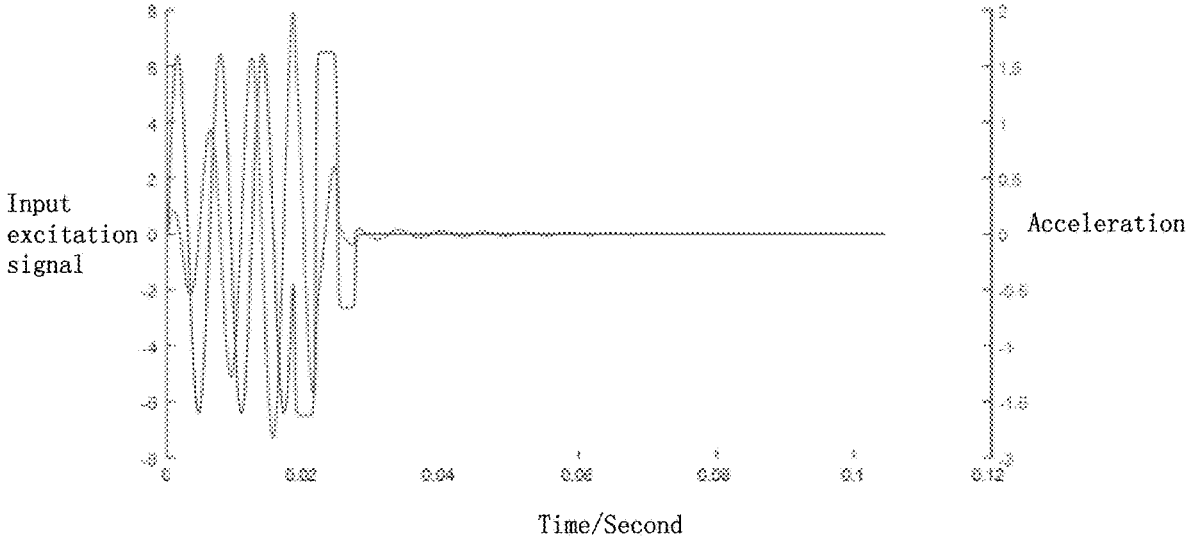
FIG. 2 is a diagram illustrating a comparison of an output of a linear motor when a traditional cyclic signal generated based on the prior art has conversion time of 0 millisecond and a sampling frequency of 64 kHz.
Figure 3:
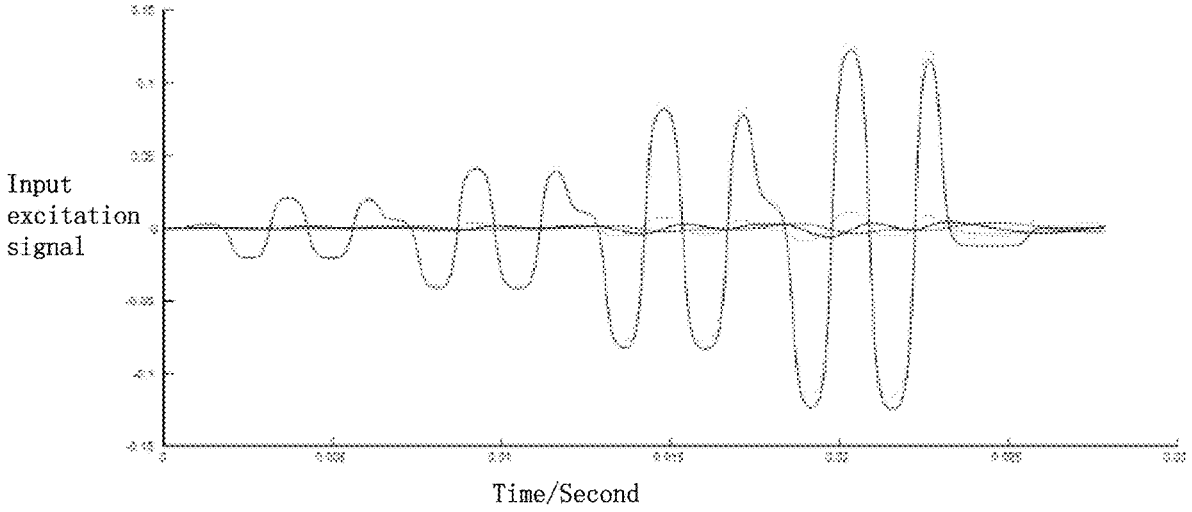
FIG. 3 is a diagram illustrating a comparison of an output of a linear motor when a vibrating signal generated in a first example of the present disclosure has a sampling frequency of 64 kHz.

Compared with the prior art, taking a linear motor as an example, as shown in FIG. 2, in a cyclic motion of a motor, a stable point of the motor, i.e., a zero point of displacement, is often a maximum point of a speed of the motor. If the motor is required to be really stopped, an additional cycle is required to approach gradually. At an initial stage of a vibration in which an accumulated error of a resonant frequency is very small, reverse braking of a cyclic signal may take at least two cycles to reduce the vibration to an acceptable range regardless of adjustment. In more cases, for example, in a case that frequency error is accumulated to a particular degree over a long-time vibration, the reverse braking of the cyclic signal is completely out of rhythm, thereby resulting in that the braking cannot be completed forever. Therefore, a method of starting and stopping a traditional cyclic signal generated in the prior art has an obvious disadvantage that it is desired to be consistent with an actual vibration frequency of a motor. However, the consistency is very difficult to be realized on a motor without displacement feedback. However, in a method of generating a vibrating signal in an example shown in FIG. 3, signals (perception of 5 ms and below 300 Hz) may be constructed within a tactile frequency range of human body by generating a basic vibrating signal for completing and stopping a motor vibration within a minimum cycle, and then combined into a cyclic signal to immediately start and stop the vibrating signal; during combination of a vibrating signal, each basic vibrating signal may be modified and spliced, namely, N vibrating sub-signals are generated according to the basic vibrating signal, and then a vibrating signal is generated by combining the vibrating sub-signals. When N vibrating sub-signals are generated according to the basic vibrating signal, vibration intensity may be linearly changed by changing input signal intensity, so that a human-perceived vibration envelope may be easily changed to achieve different vibration effects.

Figure 4:
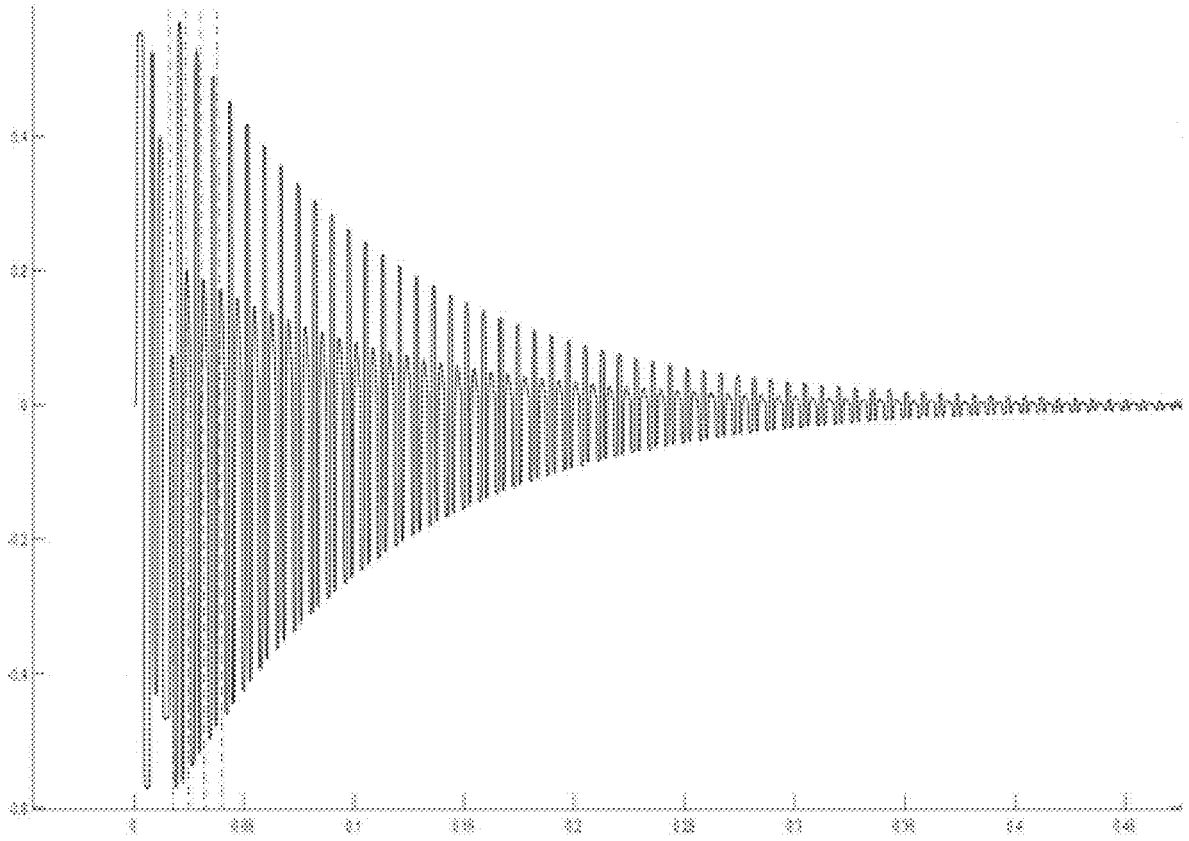
FIG. 4 is a splicing diagram illustrating a vibrating signal that is generated in a first example of the present disclosure and simulates an archery vibration effect.

Compared with a traditional sinusoidal wave that is generated in the prior art and can only be in a gradually strengthening or weakening form, a vibrating signal may be non-linearly changed in this example, to basically replace a traditional cyclic signal generated in the prior art in a general vibration, and acts better than a traditional cyclic signal in start and stop. Further, in some special vibrations, such as in the vibrations during actual vibration tactile sensation in a game or simulated life, a non-linearly constructed vibrating signal may more vividly simulate an actual vibration, and may be flexibly and freely used within a wider range. For example, for vibration effects of archery in the game, some vibration effects require an instantaneous strong vibration, and some vibration effects require a rapid judder with slight granular sensation. The traditional cyclic signal generated in the prior art cannot well achieve these effects. However, in this example, a particular vibration sub-signal may be used to simulate the instantaneous strong vibration, or a sequence of vibrating sub-signals may be used to simulate a more rapid judder, as shown in FIG. 4. For another example, for a backward force of a gunshot, a vibration wave actually sensed by a human body is not cyclic. It is very difficult for a traditional cyclic signal generated based on the prior art to simulate a backward force vibration mode because the traditional cyclic signal has disadvantages such as a fixed frequency and a slow changing process. However, a tactile sensation of the real backward force can be simulated to a great extent based on nonlinearity of information construction in this example.

Figure 5:
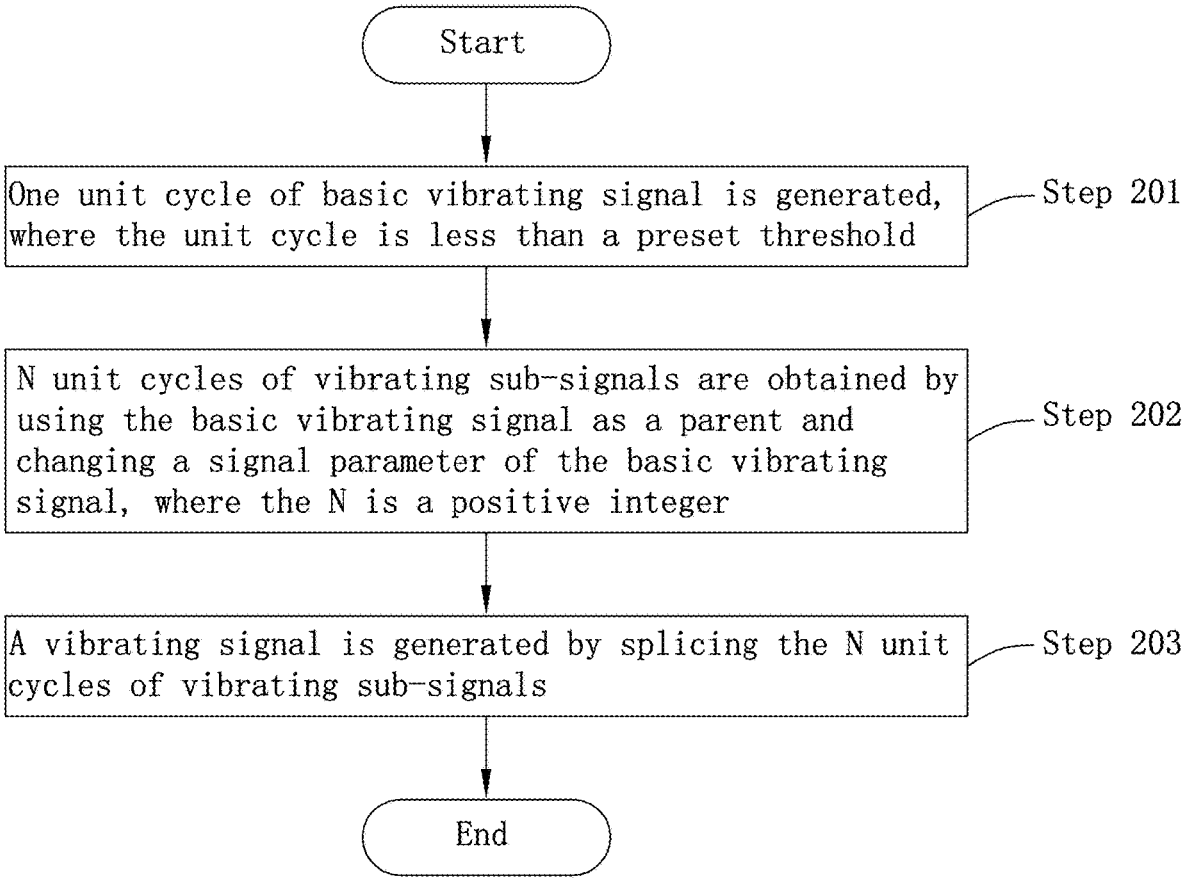
FIG. 5 is a flowchart illustrating a method of generating a vibrating signal according to a first example of the present disclosure.

A second example of the present disclosure relates to a method of generating a vibrating signal. The second example is an improvement of the first example, and the main improvement is that, in the second example of the present disclosure, after a vibrating signal is generated according to the N unit cycles of vibrating sub-signals, it is specifically included that a vibrating signal is generated by splicing the N unit cycles of vibrating sub-signals. As shown in FIG. 5, the method of generating a vibrating signal in this example specifically includes the following steps.

Step 201: one unit cycle of basic vibrating signal is generated, where the unit cycle is less than a preset threshold.

Step 202: N unit cycles of vibrating sub-signals are obtained by using the basic vibrating signal as a parent and changing a signal parameter of the basic vibrating signal, where the N is a positive integer.

Step 203: a vibrating signal is generated by splicing the N unit cycles of vibrating sub-signals.

Specifically, seamless splicing is performed on the N unit cycles of vibrating sub-signals; alternatively, gapped splicing is performed on the N unit cycles of vibrating sub-signals, where the gap is less than preset time. If the splicing of the N unit cycles of vibrating sub-signals is gapped splicing, the compactness between different vibrating sub-signals in the vibrating signal is adjusted after the splicing, so that the distribution of acceleration amplitudes in a time domain may be adjusted to realize vibrating signals with different frequencies.

Steps 201 to 202 in the second example of the present disclosure are substantially same as steps 101 to 102 in the first example, which will not be repeated herein.

Compared with the prior art, a vibrating signal is generated by performing seamless splicing or gapped splicing on the vibrating sub-signals in this example, and the compactness between different vibrating sub-signals may be adjusted after the gapped splicing so as to construct more diversified vibration modes.

The division of the steps of the above different methods is only for clear description, and the steps may be combined into a single step or divided into a plurality of steps by splitting some steps during implementation. As long as steps contain a same logic relationship, the steps all fall within the scope of protection of the present disclosure; inessential modifications added into or inessential design introduced into an algorithm or a flow without changing a core design of the algorithm and the flow shall all fall into the protection scope of the present disclosure.

Figure 6:
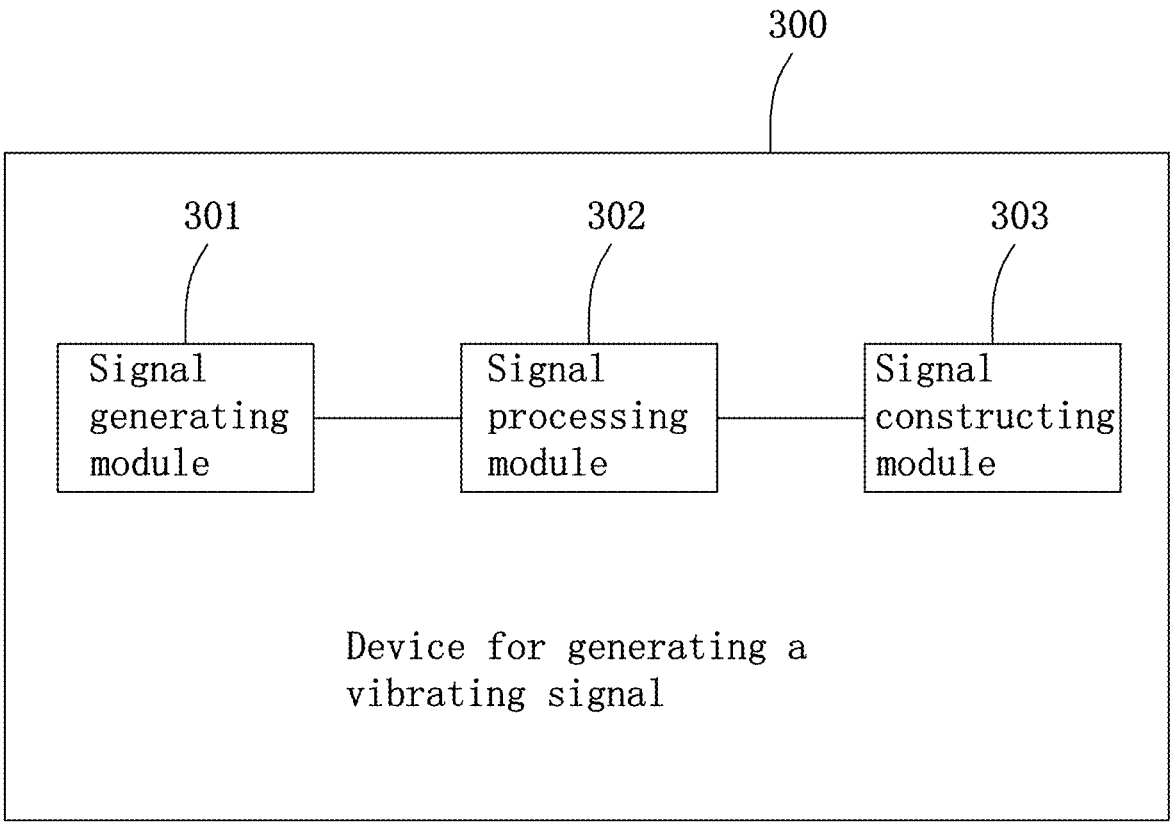
FIG. 6 is a schematic diagram illustrating a structure of a device for generating a vibrating signal according to a second example of the present disclosure.

A third example of the present disclosure relates to a device 300 for generating a vibrating signal 300. As shown in FIG. 6, the device 300 may include: a signal generating module 301, a signal processing module 302, and a signal constructing module 303.

The signal generating module 301 is configured to generate one unit cycle of basic vibrating signal, where the unit cycle is less than a preset threshold.

Specifically, the unit cycle is a minimum time length required to complete start and stop control for a vibrating signal within a tactile frequency range of human body.

The signal processing module 302 is configured to obtain N unit cycles of vibrating sub-signals by using the basic vibrating signal as a parent and changing a signal parameter of the basic vibrating signal, where the N is a positive integer.

The signal constructing module 303 is configured to generate a vibrating signal according to the N unit cycles of vibrating sub-signals.

Specifically, the signal constructing module is configured to generate a vibrating signal by splicing the N unit cycles of vibrating sub-signals.

It can be easily found that this example is a system example corresponding to the first example, and may be implemented in cooperation with the first example. Related technical details mentioned in the first example are still effective in this example and therefore will not be described here to reduce repetition. Correspondingly, the related technical details mentioned in this example may also be applied in the first example.

It is worth mentioning that each module involved in this example is a logic module. In an actual application, a logic unit may be a physical unit, may also be a part of a physical unit, and further may be a combination of a plurality of physical units. In addition, to highlight an innovative part of the present disclosure, a unit which is not closely related to technical problems solved in the present disclosure is not introduced in this example, which, however, does not indicate that no other unit exists in the example.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of generating a vibrating signal to complete and stop a motor vibration, comprising:

S10, generating one unit cycle of basic vibrating signals, wherein the unit cycle is less than a preset threshold;

S20, obtaining N unit cycles of vibrating sub-signals by using the basic vibrating signal as a parent and changing a signal parameter of the basic vibrating signal, wherein the N is a positive integer; and S30, generating a vibrating signal according to the N unit cycles of vibrating sub-signals; wherein step S30 specifically comprises generating a vibrating signal by performing gapped splicing on the N unit cycles of vibrating sub-signals with a gap less than preset time.

2. The method of generating a vibrating signal according to claim 1, wherein the unit cycle is a minimum time length required to complete start and stop control for the vibrating signal within a tactile frequency range of human body.

3. The method of generating a vibrating signal according to claim 1, wherein the signal parameter comprises one or any combination of the following: a vibrating amplitude, a frequency and a phase parameter.

4. The method of generating a vibrating signal according to claim 1, wherein step S10 specifically comprises generating one unit cycle of basic vibrating signals by a drive of an overload voltage.

5. The method of generating a vibrating signal according to claim 1, wherein step S30 also comprises:

adjusting compactness between different vibrating sub-signals in the vibrating signal after splicing, when the splicing performed on the N unit cycles of vibrating sub-signals is gapped splicing.

* * * * *